United States Patent [19]

Oguri et al.

[11] 4,366,005

[45] Dec. 28, 1982

[54] STEAM WASHING IN A DISHWASHER

[75] Inventors: Ichiro Oguri, Yao; Yoshihiro Koyama, Izumi, both of Japan

[73] Assignee: Sharp Kabushiki Kaisha, Osaka, Japan

[21] Appl. No.: 172,174

[22] Filed: Jul. 25, 1980

Related U.S. Application Data

[63] Continuation of Ser. No. 973,917, Dec. 28, 1978, abandoned.

[30] Foreign Application Priority Data

Jan. 11, 1978 [JP] Japan ..... 53-2087[U]

[51] Int. Cl.³ ..... B08B 3/00

[52] U.S. Cl. ..... 134/25.2; 134/30

[58] Field of Search ..... 134/25.2, 30, 58 D, 134/102, 108

[56] References Cited

U.S. PATENT DOCUMENTS

| | | | |
|---|---|---|---|
| 1,142,083 | 6/1915 | Dodge | 134/102 |
| 2,277,291 | 3/1942 | Blair | 134/25.3 |
| 2,564,798 | 8/1951 | Allensworth | 134/72 X |
| 2,881,780 | 4/1959 | Johnson et al. | 134/102 X |
| 3,896,827 | 7/1975 | Robinson | 134/25.3 X |
| 4,070,204 | 1/1978 | Hardy et al. | 134/25.3 |
| 4,135,531 | 1/1979 | Federighi et al. | 134/102 X |

*Primary Examiner*—Marc L. Caroff

*Attorney, Agent, or Firm*—Birch, Stewart, Kolasch & Birch

[57] ABSTRACT

Soil, including starch deposits, are removed from tableware in a dishwasher by a preliminary wash with cool water at approximately 20° C., followed by a steaming operation and then a washing operation with water containing a cleaning agent. A portion of the water to be used in the washing operation is preheated during the steaming operation.

11 Claims, 5 Drawing Figures

STEAM WASHING IN A DISHWASHER

This application is a continuation of copending application Ser. No. 973,917, filed on Dec. 28, 1978, now abandoned.

BACKGROUND AND SUMMARY OF THE INVENTION

The present invention relates to a dishwasher and, more particularly, to a dishwasher which can clean tableware in a short time.

Various automatic dishwashers have been proposed. A typical dishwasher including a heater means for heating water to a predetermined temperature was disclosed in James W. Jacobs, U.S. Pat. No. 3,923,073 entitled "MEANS FOR HEATING INCOMING WATER IN A DISHWASHER" on Dec. 2, 1975.

In the conventional dishwasher, cleaning of starch tightly attached to the tableware could not be achieved in a short time.

Accordingly, an object of the present invention is to provide a dishwasher which can clean tableware in a short time.

Another object of the present invention is to incorporate a steam washing step in an operation cycle of an automatic dishwasher.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a steam washing step is interposed between a preliminary washing step and a main washing step. The preliminary washing step continues for three minutes, wherein cool water is supplied to a washing chamber and emitted from nozzles towards tableware contained in the washing chamber. The steam washing step continues for eight minutes, wherein a high temperature steam is applied to the washing chamber. By this steam washing step, starch tightly attached to the tableware is melted.

After completion of the steam washing, the main washing is conducted for ten minutes, wherein warm water mixed with a tableware wash is emitted from the nozzles toward the tableware contained in the washing chamber. Thereafter, a rinse step is conducted for ten minutes and, then, a drying step is carried out for twenty minutes.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
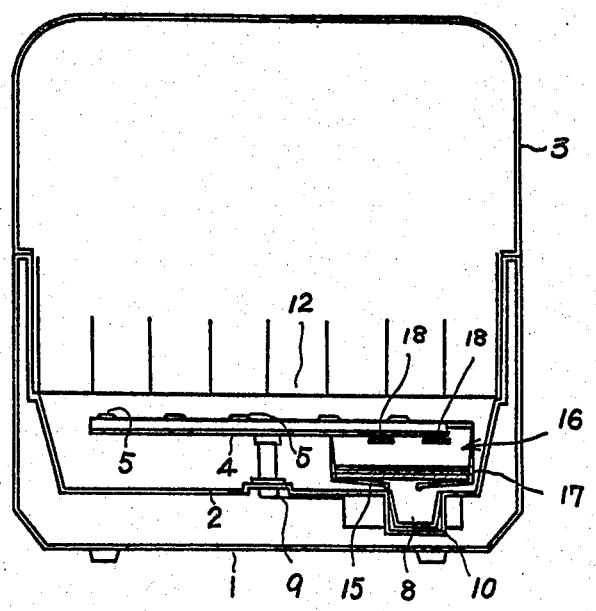
FIG. 1 is a front sectional view of an embodiment of a dishwasher of the present invention.
Figure 2:
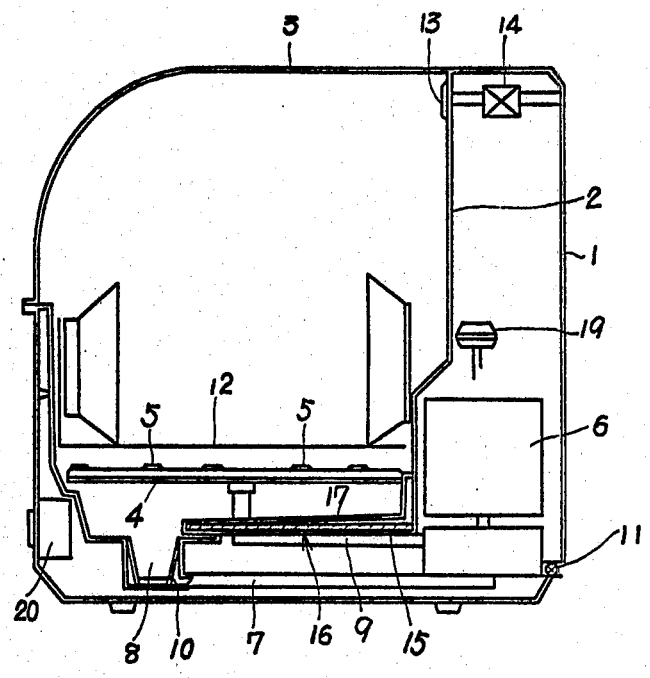
FIG. 2 is a side sectional view of the dishwasher of FIG. 1.

FIGS. 1 and 2 show an embodiment of a dishwasher of the present invention.

The dishwasher mainly comprises a casing 1, and a dishwashing tub 2 including a rotatable cover 3. A sprinkler 4 is disposed in the lower section of the dishwashing tub 2. The sprinkler 4 is provided with a plurality of nozzles 5 for emitting water towards tableware supported by a supporting rack 12. A circulation pump 6 is disposed in a clearance formed between the casing 1 and the dishwashing tub 2. The inlet side of the circulation pump 6 is communicated with a drain chamber 8 formed in the bottom wall of the dishwashing tube 2 through a drain conduit 7, and the outlet side of the circulation pump 6 is communicated with the sprinkler 4 through a supply conduit 9.

A filter 10 is disposed in the drain chamber 8. A drain valve 11 is provided for electro-magnetically controlling drain operation of water contained in the dishwashing tub 2. A feed water opening 13 is formed in an upper portion of the dishwashing tub 2 for supplying water to the dishwashing tub 2 in a shower fashion. An electromagnetic feed water valve 14 is provided for controlling water supply to the dishwashing tub 2. A heater 15 is disposed at the lower section of the dishwashing tub 2 for heating the water in a main washing step, and for generating steam in a steam washing step. These steps will be described later in detail.

Figure 3:
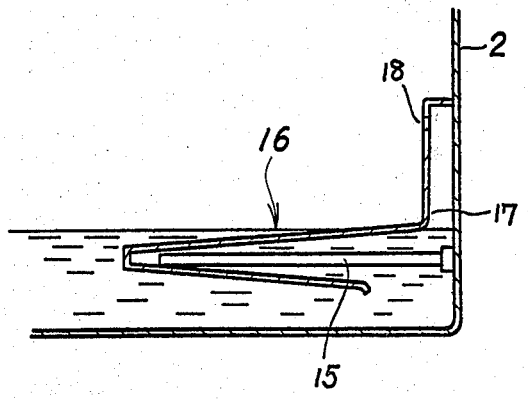
FIG. 3 is an enlarged sectional view of a steam generator employed in the dishwasher of FIGS. 1 and 2.

FIG. 3 shows a steam generator 16, which mainly comprises the heater 15 and a heater cover 17. The heater cover 17 includes a standing portion, where steam issuance openings 18 are formed. The dishwasher further comprises a level detection switch 19 for detecting a liquid level in the dishwashing tub 2. A program timer 20 is disposed in a clearance formed between the casing 1 and the dishwashing tub 2 for controlling, in combination with the level detection switch 19, operations of the circulation pump 6, the drain valve 11, the feed water valve 14 and the heater 15. More specifically, the program timer 20 controls the operation cycle of the automatic dishwasher, for example, a preliminary washing step, a steam washing step, a main washing step, a rinse step, and a drying step.

Figure 4:
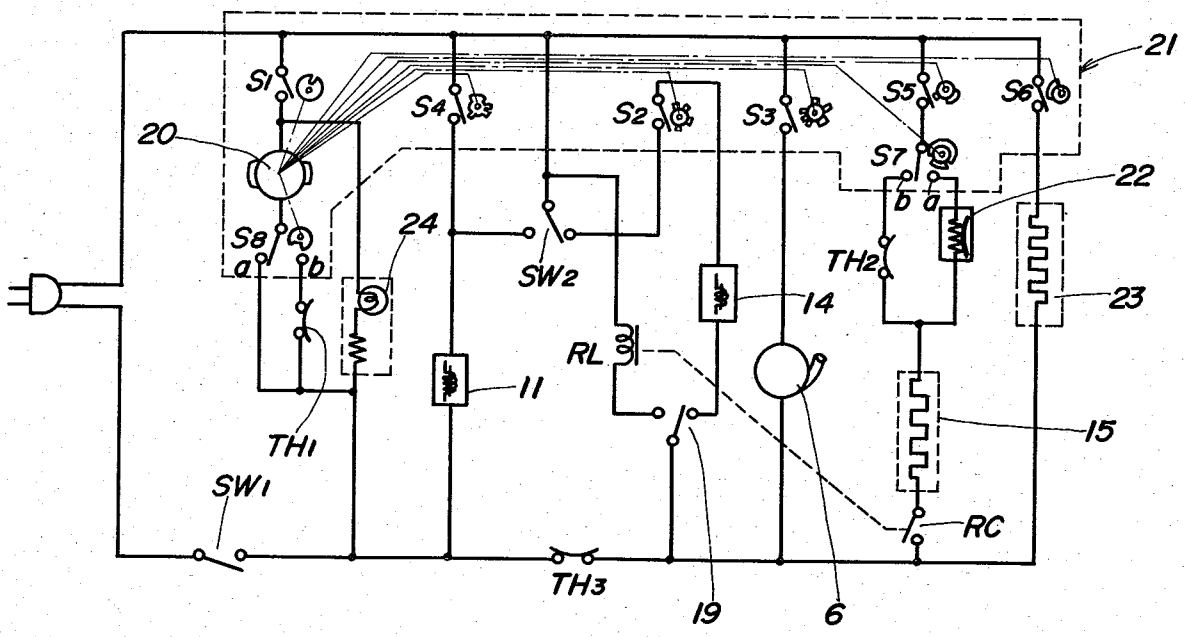
FIG. 4 is a circuit diagram of an embodiment of a control circuit of the dishwasher of the present invention.

FIG. 4 shows a control circuit of the dishwasher of the present invention. Like elements corresponding to those of FIGS. 1 through 3 are indicated by like numerals.

The control circuit mainly comprises a program cam switching unit 21 controlled by the program timer 20. More specifically, the program cam switching unit 21 comprises eight cam plates which are driven to rotate by the program timer 20. Each cam plate is associated with switches $S_1$ through $S_8$ for controlling various operations in the automatic dishwasher.

Figure 5:
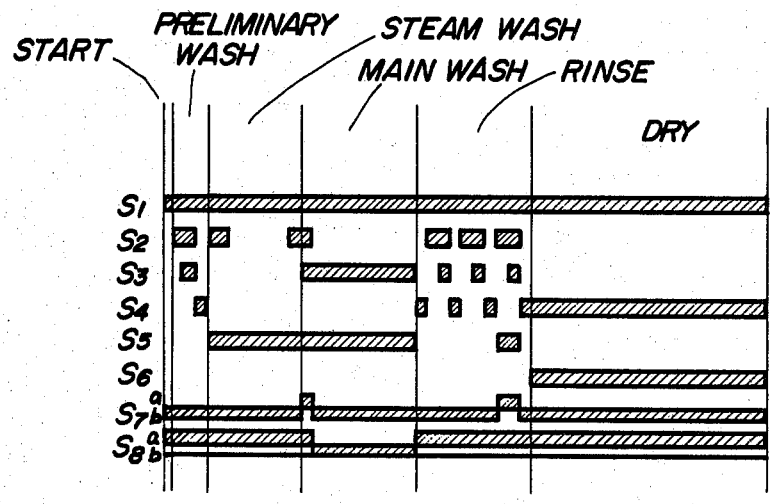
FIG. 5 is a timing chart for explaining operation of the dishwasher of the present invention.

The operation cycle of the automatic dishwasher of the present invention will be described with reference to FIGS. 4 and 5. The operation cycle mainly comprises a sequence of the preliminary washing step, the steam washing step, the main washing step, the rinsing step and the drying step.

The tableware is disposed in the supporting rack 12, which is secured in the dishwashing tub 2. When the rotatable cover 3 is closed, a door switch $SW_1$ is switched on. Thereafter, when the program timer 20 is set, the switch contact $S_1$ is closed, whereby the timer motor begins to rotate. Under these conditions, the above-mentioned sequential operations are automatically conducted.

[START]

Only the switch contact $S_1$ is maintained in its on condition in the START mode, which continues for one minute.

[PRELIMINARY WASH]

The switch $S_2$ is turned on to open the feed water valve 14. Fresh water is applied to the dishwashing tub 2 through the feed water opening 13. When the water level reaches a predetermined level, the level detection switch 19 is switched to terminate the energization of the solenoid associated with the feed water valve 14, or to close the feed water valve 14. Thereafter, the switch $S_3$ is switched on to energize the circulation pump 6. Water is emitted from the nozzles 5 formed in the sprinkler 4 towards the tableware disposed in the dishwashing tub 2. After a predetermined time period, the switch $S_3$ is switched off and the switch $S_4$ is switched on to open the drain valve 11. The water contained in the dishwashing tub 2 is drained to complete the preliminary washing step which continues for about three minutes.

[STEAM WASH]

The switches $S_2$ and $S_5$ are switched on, whereby fresh water is supplied to the dishwashing tub 2 and the heater 15 is energized. As in the case of the preliminary washing step, the water supply is terminated when the water level reaches a predetermined level. Since the heater 15 heats up the water contained in the heater cover 17, the steam is emitted from the steam issuance openings 18, whereby starch tightly attached to the tableware is melted. The steam washing step continues for about eight minutes.

[MAIN WASH]

The switches $S_2$, $S_3$ and $S_5$ are switched on. The main washing requires more water than the steam washing. When the water level reaches a predetermined level, the water supply is terminated as in the case of the preliminary washing. The steam is not emitted because the circulation pump 6 is energized. Warm water is emitted from the nozzles 5. The switch 7 is temporarily connected to a terminal a at the beginning of the main washing step to energize a bimetal 22, whereby a cleaning agent is supplied to the dishwashing tub 2 through a valve associated with the bimetal 22. The cleaning agent may be any commonly used automatic dishwashing detergent. However, a preferred cleaning agent is a non-ionized ferment containing cleaning agent such as "Finish" manufactured by Sunstar Dentifrice Co., Ltd. The main washing step continues for about ten minutes. During the main washing step, the switch $S_8$ is connected to a terminal b to enable a thermostat $TH_1$, which functions to maintain the washing water at about 50° C.

[RINSE]

When the main washing step is completed, the switch $S_4$ is switched on to open the drain valve 11. The switch contact $S_8$ is returned to the terminal a. The switch $S_2$ is switched on to open the feed water valve 14. One minute later, the switch $S_3$ is switched on to enable the circulation pump 6. Further one minute later, the switches $S_2$ and $S_3$ are switched off and the switch $S_4$ is switched on to open the drain valve 11. This cycle comprising the switching operation of switches $S_2$, $S_3$ and $S_4$ is repeated three times. At the last cycle, the switch $S_5$ is switched on and the switch contact $S_7$ is connected to the terminal a in order to energize the bimetal 22, whereby a rinse agent is supplied to the dishwashing tub 2. Any well-known rinsing agent for automatic dishwashers may be used. A preferred rinse agent is "Pure Rinse" manufactured by Kabushiki Kaisha Adeka Clean Aid.

[DRY]

The switches $S_4$ and $S_6$ are switched on, whereby the drain valve 11 is opened and a heater 23 for drying purposes is power supplied. The drying heater 23 is not necessarily required when the heater 15 is also used for drying purposes.

The control circuit further includes a lamp 24 which is activated when the main switch $S_1$ is ON for indicating the operation of the automatic dishwasher, a protection switch $SW_2$ which is operated when the level detection switch 19 is in an abnormal condition, and a relay RL which functions to close a relay contact RC only when the level detection switch 19 detects that the water is supplied to a predetermined level. A thermostat $TH_2$ functions to maintain the washing water below 70° C., and another thermostat $TH_3$ functions to prevent an abnormal high temperature.

As discussed above, the present automatic dishwasher includes the steam washing step interposed between the preliminary washing step and the main washing step. The present inventors have discovered that the cleaning efficiency is greatly enhanced when the steam washing is interposed between the preliminary washing and the main washing.

The following are experimental data showing the above-mentioned cleaning efficiency. The experimentation was conducted by the present inventors.

The cleaning efficiency is compared by three different washing sequences as follows:

1. PRELIMINARY WASH (three (3) minutes)→MAIN WASH (twenty six (26) minutes)
   cleaning efficiency . . . 79%

2. PRELIMINARY WASH (three (3) minutes)→STEAM WASH (eight (8) minutes)→MAIN WASH (eighteen (18) minutes)
   cleaning efficiency . . . 95%

3. STEAM WASH (eleven (11) minutes)→MAIN WASH (eighteen (18) minutes)
   cleaning efficiency . . . 78%

The water temperature is about 20° C. in the preliminary washing, and the water temperature reaches 65° C. at the end of the main washing. The cleaning agent "Finish" of ten (10) grams is supplied to the dishwashing tub at the beginning of the main washing step. Test samples are three large plates, four plates, four bowls, four large cups, four cups and four glasses. Rice grains of five (5) grams were attached to each test sample and dried by application of an heated air flow (60° C.) for thirty minutes before the washing.

The cleaning efficiency is calculated through the use of the following formula and score table.

SCORE TABLE cleaning efficiency =

$$\frac{\Sigma\left\{(\text{score}) \times \left(\begin{array}{c}\text{number of test sample which}\\ \text{bears the specific score}\end{array}\right)\right\}}{5 \times (\text{total number of test sample})}$$

| SCORE | CONDITION |
|---|---|
| 5 | completely cleaned |
| 4 | one or two small stains (about 1mmϕ) are observed; or a starch film is slightly observed only a portion of the sample |
| 3 | one, two or three rice grain size stains are observed; or a starch film of a size below 4 $cm^2$ is apparently observed |
| 2 | four through seven rice grain size stains are observed; or a starch film of a size 5 to 24 $cm^2$ is apparently observed |
| 1 | rice grain size stains are observed more than eight; or a starch film excess of 25 $cm^2$ is apparently observed |

The invention being thus described, it will be obvious that the same may be varied in many ways. Such variations are not to be regarded as a departure from the spirit and scope of the invention, and all such modifications are intended to be included within the scope of the following claims.

What is claimed is:

1. A dishwashing method for washing tableware disposed within a dishwasher comprising the steps of:

preliminarily washing tableware disposed in said dishwasher with cool water having a temperature of approximately 20° C. to initially rinse the surfaces of the tableware for removing particles and substances adhering to the tableware;

applying steam to said tableware after completion of said preliminary washing step and simultaneously preheating water for later use, said steam being applied for a predetermined time interval for removing particles and substances, including starch, adhering to the tableware;

washing said tableware after completion of said steam washing step for an additional time period to substantially remove remaining particles by contacting said tableware with said preheated water and a predetermined quantity of additional water, said wash water containing a cleaning agent;

rinsing said tableware for a predetermined time period; and drying said tableware for a predetermined time period.

2. A method of washing tableware disposed within a dishwasher comprising the steps of:

preliminarily washing tableware in said dishwasher by splashing cool water having a temperature of approximately 20° C. on said tableware to initially rinse the surfaces of the tableware for removing particles and substances adhering to the tableware;

steaming said tableware and simultaneously preheating water for later use after completion of said preliminary washing step, said steam being applied for a predetermined time interval for removing particles and substances including starch, adhering to the tableware;

washing said tableware after completion of said steam washing step for an additional time period to substantially remove remaining particles by contacting said tableware with said preheated water and a predetermined quantity of additional water, said wash water containing a cleaning agent; and rinsing said tableware for a predetermined time period.

3. The dishwashing method of claim 1, wherein said step of preliminarily washing comprises the step of splashing said cool water without a cleaning agent on said tableware.

4. The dishwashing method of claim 1 or 3, wherein said step of preliminarily washing continues for about three minutes, said step of applying said steam continues for about eight minutes, and said step of washing continues for about ten minutes.

5. The dishwashing method of claim 4, wherein said step of applying steam functions to melt starch tightly attached to said tableware.

6. The method of claim 1 or 3, wherein said step of preliminarily washing continues for about three minutes, said step of applying steam continues for about eight minutes, and said step of washing continues for about eighteen minutes.

7. The method of claim 2, wherein said preliminary washing step continues for approximately three minutes, said steaming step continues for approximately eight minutes, and said washing step continues for approximately ten minutes.

8. The method of claim 2, wherein said preliminary washing step continues for approximately three minutes, said steaming step continues for approximately eight minutes, and said washing step continues for approximately eighteen minutes.

9. The method of claim 3, wherein said steaming step melts starch tightly adhering to said tableware.

10. The method of claim 1 or 2, wherein during the washing step said preheated water and said additional water is recirculated.

11. The method of claim 10, wherein said preheated water and said additional water is maintained at a temperature of approximately 65° C.

* * * * *